US006932221B2

(12) United States Patent
McMurray

(10) Patent No.: US 6,932,221 B2
(45) Date of Patent: Aug. 23, 2005

(54) MOUNTING APPARATUS

(76) Inventor: William McMurray, 19140 St. Marys, Detroit, MI (US) 48235

( * ) Notice: Subject to any disclaimer, the term of this patent is extended or adjusted under 35 U.S.C. 154(b) by 0 days.

(21) Appl. No.: 10/347,068

(22) Filed: Jan. 17, 2003

(65) Prior Publication Data

US 2003/0102273 A1 Jun. 5, 2003

Related U.S. Application Data

(63) Continuation-in-part of application No. 09/874,751, filed on Jun. 5, 2001, now abandoned.

(51) Int. Cl.[7] ..... E05B 73/00
(52) U.S. Cl. ..... 211/4; 211/64
(58) Field of Search ..... 211/64, 4, 5, 60.1; 42/94; 248/552; 70/58; 206/317

(56) References Cited

U.S. PATENT DOCUMENTS

| | | | | | |
|---|---|---|---|---|---|
| 920,132 | A | | 5/1909 | Greener | |
| 1,033,915 | A | | 7/1912 | McDonald | 211/4 |
| 3,419,154 | A | | 12/1968 | Shapiro et al. | 211/7 |
| 3,659,721 | A | | 5/1972 | Parillo | 211/4 |
| 3,982,633 | A | | 9/1976 | Pennington | 211/4 |
| 4,139,100 | A | * | 2/1979 | Reed | 211/4 |
| 4,155,458 | A | * | 5/1979 | Moline | 211/4 |
| 4,204,601 | A | | 5/1980 | Thomas | 211/4 |
| 4,254,879 | A | | 3/1981 | Maule | 211/4 |
| 4,462,497 | A | | 7/1984 | Maule | 211/7 |
| 4,624,372 | A | * | 11/1986 | Brolin | 211/4 |
| 4,696,405 | A | * | 9/1987 | Waring | 211/4 |
| 4,696,461 | A | * | 9/1987 | Zelinski | 269/16 |
| 4,844,257 | A | | 7/1989 | Seynhaeve | 206/279 |
| 5,026,013 | A | | 6/1991 | Robbins | 248/223.1 |
| 5,154,072 | A | | 10/1992 | Leyden | 70/18 |
| 5,178,283 | A | | 1/1993 | Ennis | 211/4 |
| 5,282,539 | A | * | 2/1994 | Saathoff | 211/64 |
| 5,287,972 | A | | 2/1994 | Saathoff | 211/64 |
| 5,509,542 | A | | 4/1996 | Simmerman et al. | 211/124 |
| 5,675,999 | A | | 10/1997 | Carlstrom | 70/18 |
| 5,683,021 | A | | 11/1997 | Setina | 70/162 |
| 5,823,358 | A | | 10/1998 | Leyden et al. | 211/8 |
| 5,887,730 | A | * | 3/1999 | St. George | 211/4 |
| 6,012,692 | A | | 1/2000 | Meck | 248/251 |
| 6,113,045 | A | | 9/2000 | Kuo | 211/105 |
| 6,142,313 | A | | 11/2000 | Young | 211/4 |
| 6,205,823 | B1 | * | 3/2001 | Volk, Sr. | 70/58 |
| 6,330,815 | B1 | | 12/2001 | Duncan | 70/58 |
| 6,478,165 | B1 | * | 11/2002 | Noble | 211/4 |
| 6,491,169 | B1 | * | 12/2002 | Salonen | 211/4 |

* cited by examiner

*Primary Examiner*—Jennifer E. Novosad
(74) *Attorney, Agent, or Firm*—Gifford, Krass, Groh, Sprinkle, Anderson & Citkowski, P.C.

(57) ABSTRACT

A mounting apparatus includes a base having a first and a second end. A first support member is positioned on the first end of the base and a second support member is positioned on the second end of the base. A locking bar is pivotably secured at one end to the second support member and has at an opposite end a lock. The lock engages and is securable to the first support member. Finally, a post is moveably secured to the base. The post engages a switch of a device (e.g., firearm, tool or like device) to prevent activation of the device.

14 Claims, 5 Drawing Sheets

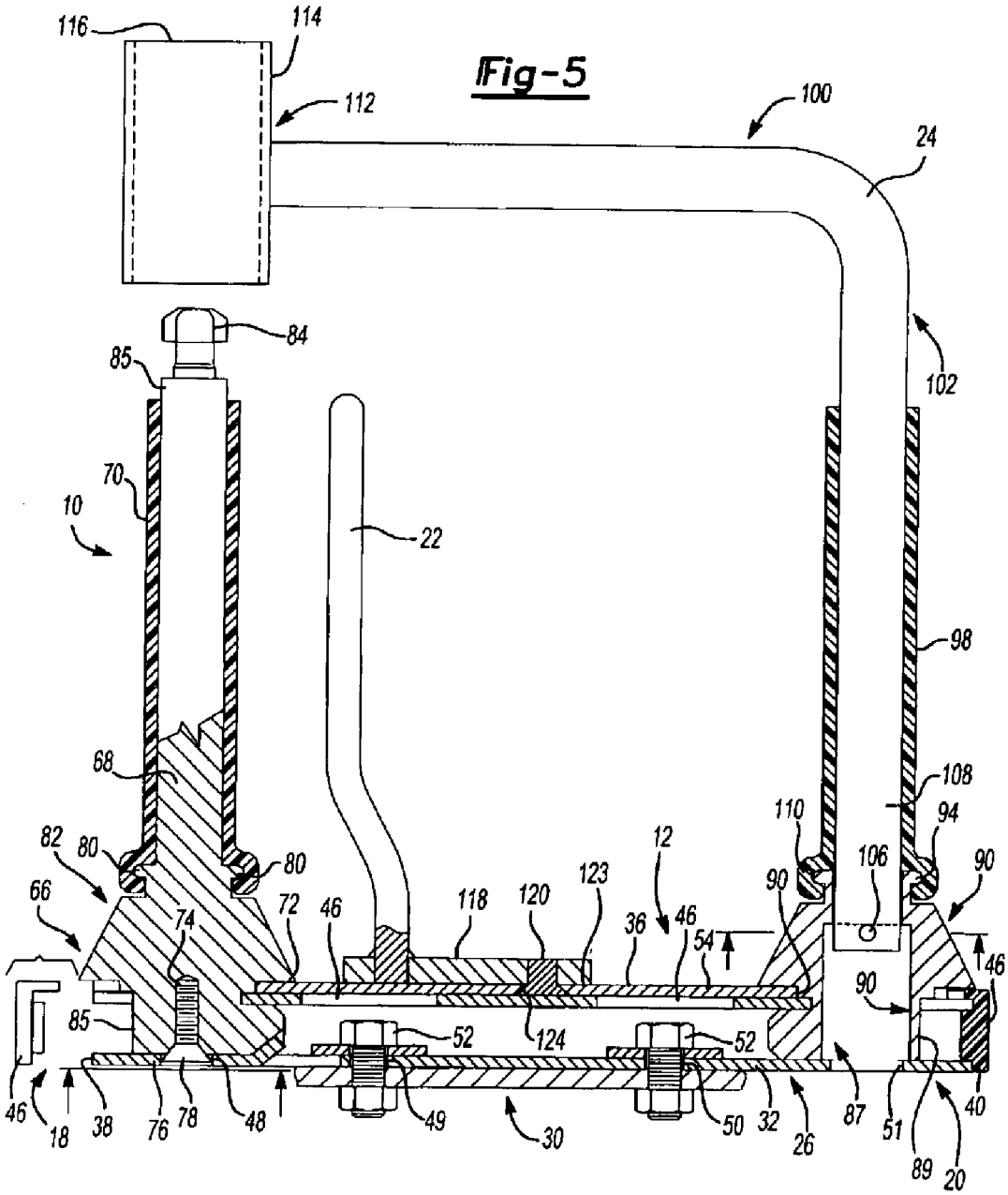
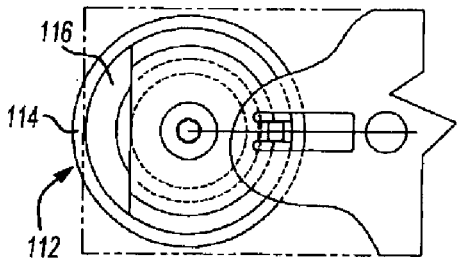
Fig-6
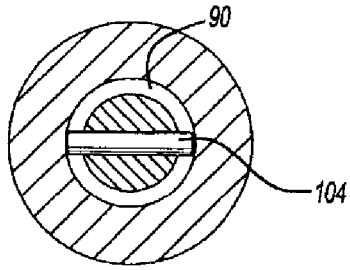
Fig-7

MOUNTING APPARATUS

RELATED APPLICATION

This application is a continuation-in-part of U.S. patent application Ser. No. 09/874,751 filed Jun. 5, 2001 entitled "Apparatus for Supporting Articles" now abandoned.

BACKGROUND OF THE INVENTION

1. Field of the Invention

The present invention is directed to a mounting apparatus. More particularly, the present invention is directed to an apparatus for safely and securely mounting or displaying firearms, tools and the like.

2. Reference to Related Art

The safekeeping of firearms is an issue of considerable importance to every gun owner; particularly gun owners who are parents. Generally, it is not enough to simply "lock up" a firearm. Additional, precautions should also be taken to ensure that a firearm cannot be discharged even it is locked away in a secure cabinet or display case.

The safekeeping devices, like firearms, or even power tools, also presents a considerable dilemma for firearm retailers. Typically, the retailer wants prospective purchasers to "get a feel for" the device by allowing those purchasers to closely examine the product. However, that examination must not come with a risk of security to the retailer or other purchasers.

In order to address similar concerns regarding the potential theft of retail goods a variety of stands and mounts have been developed in the prior art. For example, U.S. Pat. No. 4,462,497 to Maule discloses a display stand including a base that has at each end an outwardly extending rod. A crossbar is pivotally secured to an end of one rod and extends parallel to the base to engage a lock that is positioned on the other end of the rod. Using this system, a retailer can publicly display and allow examination of a variety of objects without worrying about possible theft or misuse.

A similar type of device is disclosed in U.S. Pat. No. 4,254,879, which is also issued to Maule. In this system, the crossbar and one rod include circular end portions that are engaged and secured together by a lock.

A gun rack is disclosed in U.S. Pat. No. 5,287,972 to Saathoff. The gun rack includes a number of horizontally extending sleeves that are used for supporting a firearm. A pair of vertically extending crossbars extend over the sleeves to secure the firearm in the rack.

SUMMARY OF THE INVENTION

The apparatus of the present invention includes a base that has a mounting plate, a faceplate positioned on a upper surface of the mounting plate, a backing plate position on a lower surface of the mounting plate and a first and a second end. The upper surface of the mounting plate and a top surface of the faceplate each having U-shaped openings defined in each end.

A first support member is positioned on the first end of the base of the apparatus and includes a base and a support rod extending from the base. The base of first support member is preferably a conical base that has circumferentially extending groove that engages the U-shaped opening of the mounting plate and faceplate upon positioning of the first support member on the first end of the base. A flange is disposed on an upper portion of the base of the first support member. The support rod has a lock head disposed on an end opposite the base of the first support member. A sleeve having a flared end portion is positioned around the support rod. The flared end portion of the sleeve engaging the flange of the base of the first support member.

A second support member includes a base having a longitudinally extending axial bore extending therethrough and is adapted to engage the second end of the base of said apparatus. The base of the second support member is preferably a conical base that has an circumferentially extending groove that engages the U-shaped opening of the mounting plate and faceplate upon positioning of the first support member on the second end of the base. A flange is disposed on an upper portion of the base of the second support member.

A locking bar has vertical portion that is pivotably secured to the second support member and a horizontal portion that includes a lock. The lock releasably engages the lock head of the support rod. A second sleeve having a flared end portion is positioned around the vertical portion of the locking bar and is secured, by the flared end portion to the flange of the base.

A post is moveably secured to a pivot plate that is secured to the base between the ends of the base. The post is adapted to engage a trigger (switch) of a device to prevent activation of the device. Preferably, the pivot plate is a disk. Alternatively, the pivot plate is a crossbar.

In an alternative embodiment of the present invention, the mounting apparatus includes a base, a support member positioned on base, a lock that releasably secured to an end of said support member opposite said base, a post housing secured to said lock housing and a post that is moveably secured to the base and extends from the base to engage the post housing when the lock is secured to the support member.

BRIEF DESCRIPTION OF THE DRAWINGS

A better understanding of the present invention will be had upon reference to the figures wherein like reference numerals refer to like parts throughout and wherein:

FIG. 5 is a side cutaway view of a preferred embodiment of the apparatus;

FIG. 6 is a top view showing the lock of the preferred embodiment of the apparatus;

FIG. 7 is a bottom view showing the throughbore of the second support member of the apparatus;

DETAILED DESCRIPTION OF THE INVENTION

Figure 1:
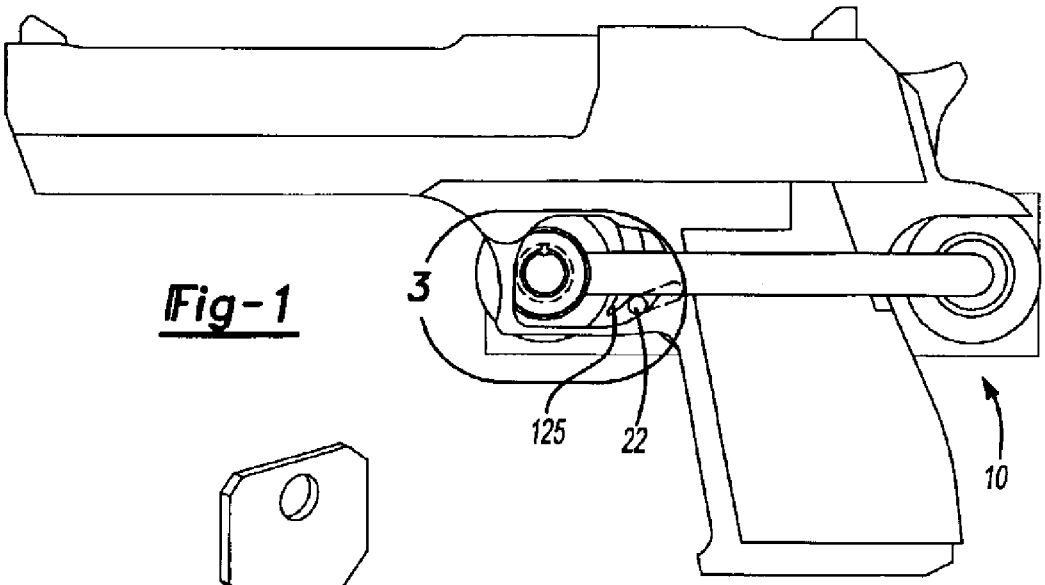
FIG. 1 is a side environmental view showing a preferred embodiment of an apparatus constructed in accordance with the present invention being used with a firearm.

Referring now to FIGS. 1–8, there is shown an apparatus 10 constructed in accordance with a preferred embodiment of the present invention. The apparatus 10 includes a base 12, a first 14 and a second 16 support member positioned at each end 18, 20 of the base 12, a post 22 positioned on the base 12 between the first 14 and second 16 support members and a locking bar 24 that is pivotally secured to the second support member 16 and adapted to engage the first support member 14.

Figure 2:
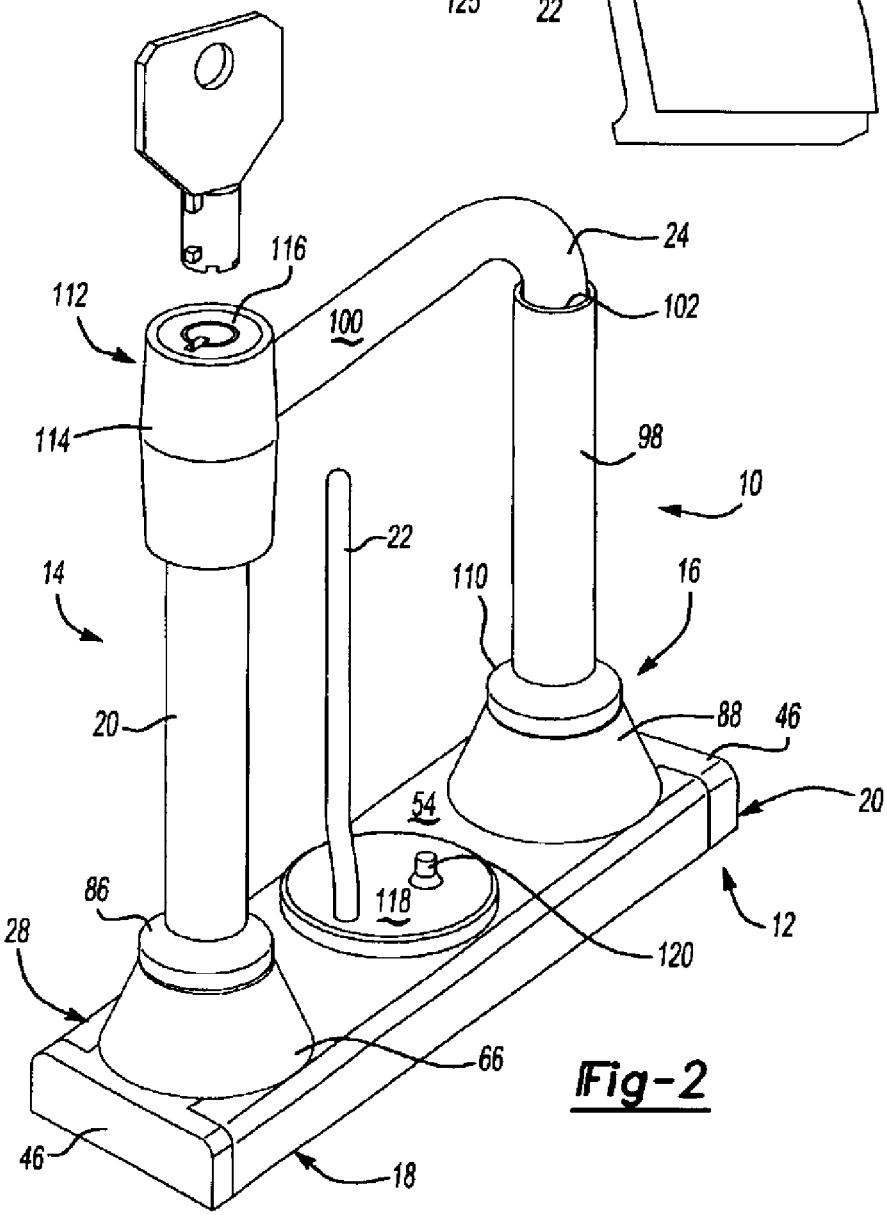
FIG. 2 is a perspective view of a preferred embodiment of the apparatus.
Figure 3:
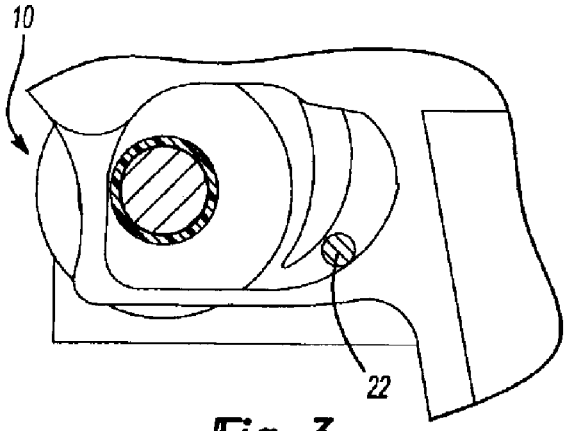
FIG. 3 is a side view of the apparatus taken from circled area 3 of FIG. 1.
Figure 4:
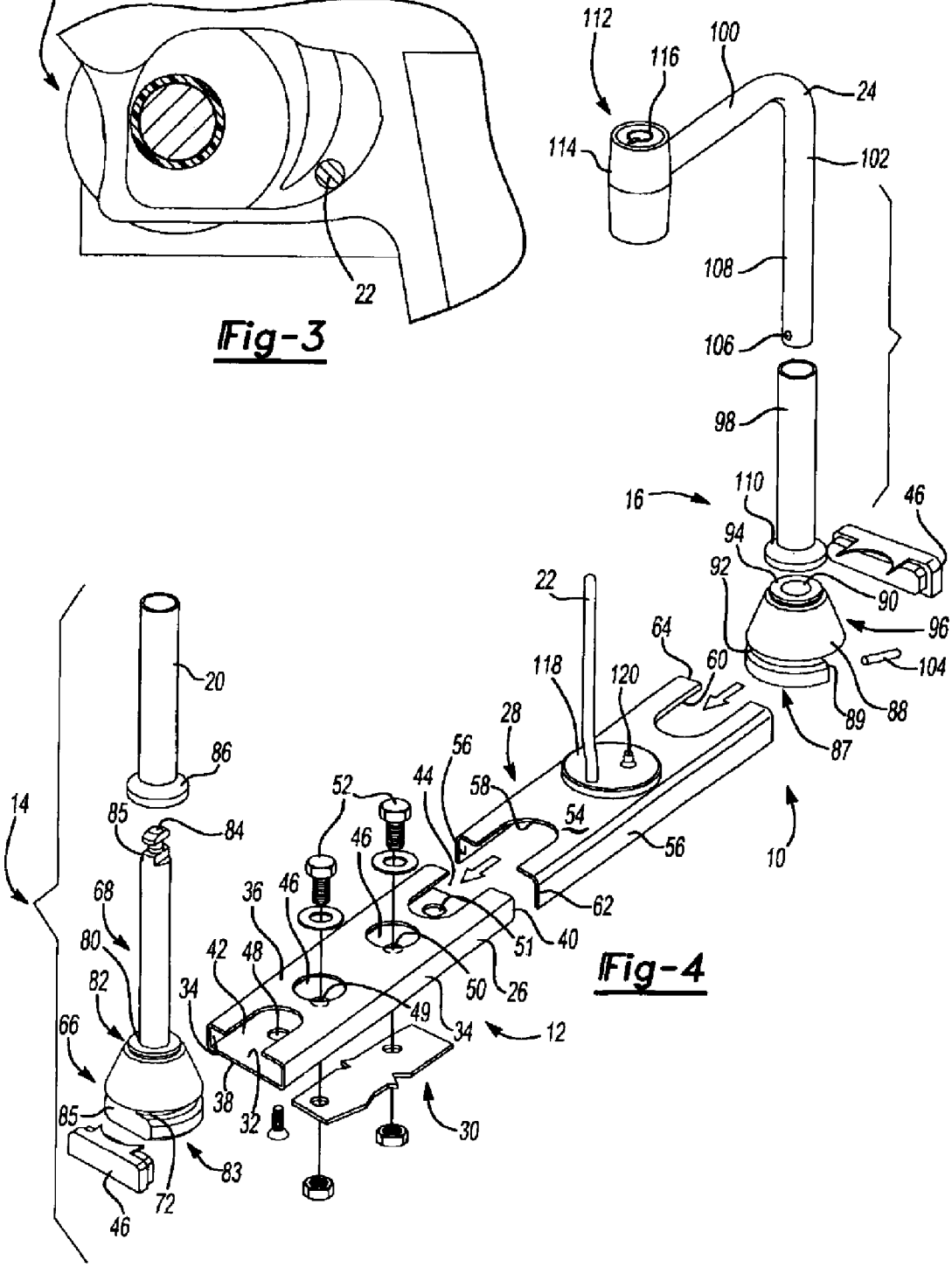
FIG. 4 is an exploded perspective view of a preferred embodiment of the apparatus.

Still referring to FIGS. 1–8 and as best shown in FIGS. 2, 4 and 5, the base 12 of the present invention includes a mounting plate 26, a faceplate 28 that is positioned over the mounting plate 26 and a backing plate 30. The base 12 is preferably constructed of steel. However, other metals and alloys having the requisite strength and support characteristics can also be used in the construction of the base. For example, the faceplate 28 can be constructed of a stainless steel or otherwise be chrome plated. The mounting plate 26 (see FIG. 2) is a rectangular, box-like structure that includes a lower surface 32, a pair of sidewalls 34 and an upper surface 36; the sidewalls 34 and surfaces 32, 36 defining an open interior for the mounting plate 26. The ends 38, 40 of the mounting plate are open and a U-shaped opening 42, 44 is defined in each end 38, 40 of the upper surface 36 of the mounting plate 26 to facilitate engagement with the support members 14, 16 as will be described below. The ends 38, 40 of the mounting plate 26 are sealed by the insertion of end caps 46 following the positioning of the support members 14, 16 in the U-shaped openings 42, 44.

A pair of circular apertures 46 (FIG. 4) are defined in the upper surface 36 between the U-shaped openings 42, 44. Likewise, a series of four apertures 48, 49, 50, 51 are defined in the lower surface 32 of the mounting plate 26 and are in alignment with the U-shaped openings 42, 44 and apertures 46, respectively, of the upper surface 36. A pair of bolts 52 extend through the apertures 46 in the upper surface 36 and the lower surface 32 and secure the mounting plate 26 to the backing plate 30. Alternatively, or additionally, it will be appreciated by those having skill in the art that the mounting plate 26 and backing plate 30 arrangement can be used to secure the apparatus 10 to a wall or similar surface (not shown).

Still referring to FIGS. 2, 4 and 5, the faceplate 28 of the base 12 includes a top surface 54 and a pair of sidewalls 56 extending from the top surface 54. A pair of U-shaped openings 58, 60 are defined in each end 62, 64 of the top surface 54. The top surface 54 and sidewalls 56 of the faceplate 28 are positioned over the upper 36 surface and sidewalls 34 respectively of the mounting plate 26. Preferably, in positioning the faceplate 28 on the mounting plate 26 the U-shaped openings 58, 60 of the faceplate 28 are aligned with the U-shaped openings 42, 44 of the mounting plate 26.

Still referring to FIGS. 2, 4 and 5, the first support member 14 includes a base, preferably a first conical base 66, having a support rod 68 extending therefrom and a first sleeve 70 that is slidably fitted over the support rod 68. Preferably, the first support member is constructed of steel. However, other metals or alloys have the requisite strength characteristics can also be used in the construction of the first support member 14. Alternatively, the first sleeve 70 can be constructed from a polymer material, e.g., plastic, or a reinforced material e.g., carbon fiber or Teflon®.

The first conical base 66 includes a circumferentially extending groove 72 (as shown in FIG. 4) that engages U-shaped openings 42, 62 of the base (when the faceplate 28 is secured to the mounting plate 28) to thereby secure the first support member 14 to the base 12. An axially extending tap 74 (see FIG. 5) is disposed in a bottom 76 of the conical base 66 and is engaged by a screw 78 that extends through an aperture 48 in the lower surface 32 of the mounting plate 26 to secure the first support member 14 to the base 12. A flange 80 is positioned at an upper portion 82 of the first conical base 66 and, as described below, is used for securing the first sleeve 70. A lower portion 83 of the conical base 66 is cut away on a side opposite the direction of insertion of the conical base 66 into the base 12 to provide a face surface 85 and allow additional room for the positioning of an end cap 46.

Referring now to FIGS. 2 and 4–6, the support rod 68 extends from the first conical base 66 and includes a lock head 84 at an end 85 opposite the conical base 66. The first sleeve 70 has a flared end portion 86. As best shown in FIG. 5, the flared end 86 portion of the first sleeve 70 engages the flange 80 of the first conical base 66 secured to the first sleeve 70 to the support rod 68.

As shown in FIGS. 2, 4 and 5, the second support member 16 includes a base, preferably a second conical base 88 having a longitudinally extending axial bore 90 extending therethrough. As with the first conical base 66, the second conical base 88 has a circumferentially extending groove 92 that is adapted to engage a U-shaped opening 44, 64 of the base 12 (when the faceplate 28 is secured to the mounting plate 26) to secure the second support member 14 in the base 12. However, since it may sometimes be necessary to remove the conical base 88 and associated locking bar 24 (to facilitate access to the displayed object), it is not necessary to secure the second conical base 88 to the base 12 by means of a screw or the like. A flange 94 is positioned at an upper portion 96 of the second conical base 88 and, as described below, is used for securing a second sleeve 98. A lower portion 87 of the conical base 88 is cut away on a side opposite the direction of insertion of the conical base 88 into the base 12 to provide a face surface 89 and allow additional room for the positioning of an end cap 46.

Preferably, the second support member 16 is constructed of steel. However, other metals or alloys have the requisite strength characteristics can also be used in the construction of the sealed supports member 16. Alternatively, the second sleeve 98 can be constructed from a polymer material, e.g., plastic, or a reinforced material e.g., carbon fiber or Teflon®.

Referring now to FIGS. 2, 4, 5, 7 and 8, the locking bar 24 is preferably an L-shaped rod having a horizontal portion 100 and a vertical portion 102. The vertical portion 102 of the locking bar 24 pivotally engages the axial bore 90 of the second conical base 88 and secured to the base 88 by means of a pin 104 (see FIGS. 4 and 7) extending through an aperture 106 disposed in an end 108 of the vertical portion 102 of the bar 24.

Referring now to FIGS. 2, 4, 5 and 7, the second sleeve 40 is adapted to slide over the vertical portion 102 of the locking bar 24 prior to the insertion at the bar 24 into the bore 90 of the second conical base 88. As shown in FIG. 5, the second sleeve 98 includes a flared end portion 110 that engages the flange 94 on the upper portion 96 of the second conical base 88.

As shown in FIGS. 2, 4, 5, 6 and 8, the horizontal portion 100 of the locking bar 24 has at an end a lock 112, including a lock housing 114 and cylinder 116. Preferably, the lock 112 is releasably secured to the lock head 84 positioned on the end 85 of the support rod 68 of the first support member 14.

Figure 8:
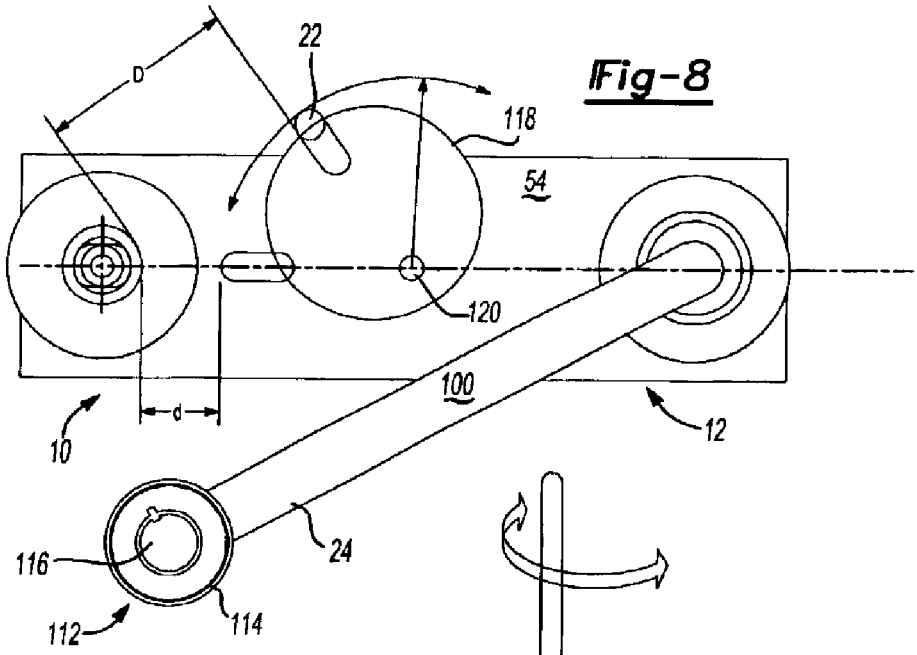
FIG. 8 is a top planar view of the preferred embodiment.

Therefore, it will be appreciated that when the apparatus 10 of the present invention is in use and locked, it creates a complete ring formed by the base 12, first support member 14 and second support member 16 and locking bar 24. As shown in FIG. 8, when the apparatus 10 is unlocked, the locking bar 24 and be pivoted away from the first support member 14 to thereby open the apparatus 10.

Figure 12:
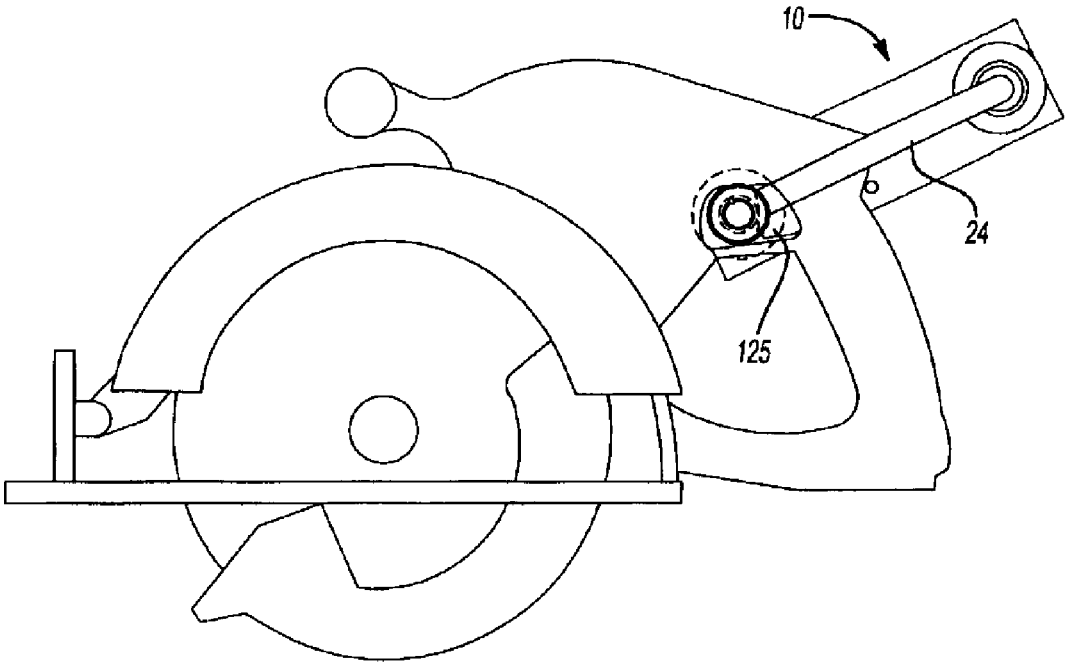
FIG. 12 is a side view showing the preferred embodiment of the present invention being used with a tool.

Referring now to FIGS. 1–5 and 8, the post 22 extends from a pivot plate 118 that is positioned on the top surface 54 of the faceplate 28. Preferably, the pivot plate 118 is pivotably secured to a pin 120 that extends upwardly through an aperture 122 in the faceplate 28. As best shown in FIG. 5, the pin 120 includes a flared end 124 that is adapted to engage the wall of the aperture 122. The positioning of the faceplate 28 over the mounting plate 26 thereby secures the pin 120 in position. Using the pivot base 118, the post 22 is positionable behind a switch 124 of a device (e.g., a trigger of a firearm (FIGS. 1, 3) or the switch of a tool (FIG. 12) or similar device (see FIG. 3)) while the device is secured in the apparatus 10. The positioning of the post 22 in such a manner prevents the movement of the switch 124 and a potential activation of the device.

Figure 9:
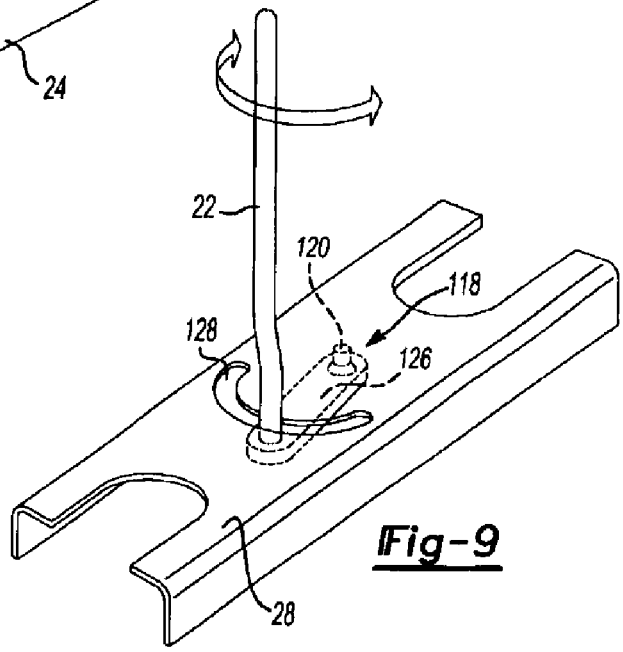
FIG. 9 is an alternative view of the mounting plate and post of the present invention.

As shown in FIGS. 2, 4 and 8, the pivot base 118 of the post 22 is shown as a substantially circular disk. However, it will be appreciated that various other modifications could also be applied to pivot the post 22. For example, in FIG. 9 there is shown an alternative embodiment wherein the pivot base 118 is a crossbar 126 extending between the pin 120 and the post 22. The post 22 extends through a semi-circular aperture 128 defined in the faceplate 28.

Figure 10:
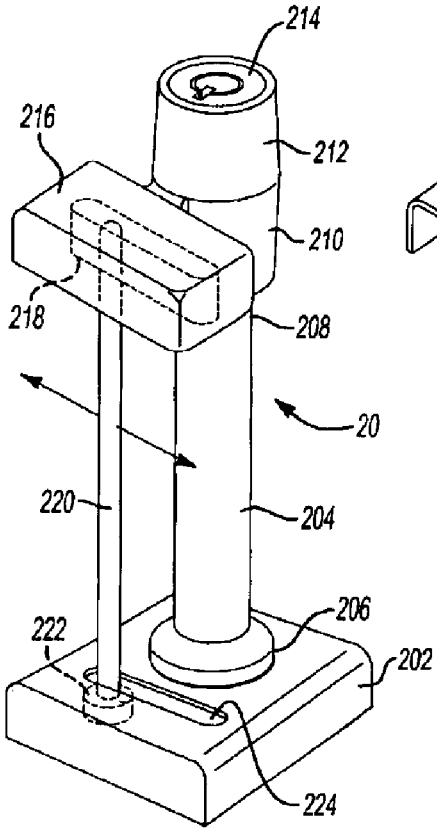
FIG. 10 is a perspective view showing a first alternative embodiment of an apparatus constructed in accordance with the present invention.
Figure 11:
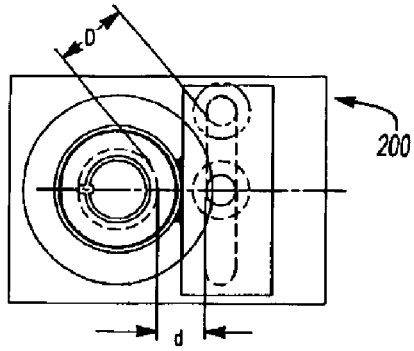
FIG. 11 is a top view of the alternative embodiment.

Referring now to FIGS. 10 and 11, there is shown an apparatus 200 constructed in accordance with an alternative embodiment of the present invention. The apparatus of the alternative embodiment includes a base 202, a support member 204 secured at one end 206 to the base 202 and having removably secured at an opposite end 208 a lock 210, including a lock housing 212 and a cylinder 214. A post housing 216 is affixed to the lock housing 212 and defines a channel 218. A post 220 is moveably secured at one end 222 into a groove 224 defined in the base 202 and extends to engage, with an opposite end 226, the channel 218 of the post housing 216. It will thus be appreciated that the release the lock 210 from the support member 204 permits a user to open the apparatus 10 and position a device.

Having thus described my invention, various other embodiments will become apparent to those having skill in the art that do not depart from the scope of the claims.

I claim:

1. A mounting apparatus comprising:

a base having a first end and a second end, a mounting plate and a faceplate positioned on said mounting plate;

a first support member positioned on said first end of said base, said first support member including a support base and a support rod extending from said support base;

a second support member positioned on said second end of said base, said second support member including a support base having a bore extending therethrough;

a locking bar pivotably secured in said bore of said second support member, said locking bar having a lock, said lock being adapted to be releasably secured to said support rod of said first support member; and a post pivotably secured to said faceplate of said base between said first and second end of said base, said post being adapted to engage a device to prevent actuation of said device.

2. A mounting apparatus comprising:

a base having a first end and a second end;

a first support member positioned proximate said first end of said base;

a second support member positioned proximate said second end of said base;

a locking bar moveably secured at a first end to said second support member and having at a second end a lock, said lock being adapted to be releasably secured to said first support member;

a post moveably secured to said base between said ends of said base, said post being adapted to engage a switch of a device positioned in said apparatus to prevent actuation of said device;

said base comprising a mounting plate and a faceplate, said mounting plate comprising an upper surface having a pair of ends, each end of said upper surface having a U-shaped opening defined therein; and said faceplate comprising a top surface having a pair of ends, each end of said top surface of said faceplate having a U-shaped opening defined therein.

3. The apparatus of claim 2, wherein said first support member comprises a base and a support rod extending from said base, said base of said support member being adapted to engage an end of said base of said apparatus.

4. A mounting apparatus comprising:

a base having a first end and a second end;

a first support member positioned proximate said first end of said base;

a second support member positioned proximate said second end of said base;

a locking bar moveably secured at a first end to said second support member and having at a second end a lock, said lock being adapted to be releasably secured to said first support member; and a post moveably secured to said base between said ends of said base, said post being adapted to engage a switch of a device positioned in said apparatus to prevent actuation of said device; and said first support member comprising a conical base and a support rod extending from said base, said base of said support member being adapted to engage an end of said base of said apparatus.

5. The apparatus of claim 4, wherein conical base further comprises a flange positioned on an upper portion of said conical base and a circumferentially extending groove.

6. A mounting apparatus comprising:

a base having a first end and a second end;

a first support member positioned proximate said first end of said base;

a second support member positioned proximate said second end of said base;

a locking bar moveably secured at a first end to said second support member and having at a second end a lock, said lock being adapted to be releasably secured to said first support member; and a post moveably secured to said base between said ends of said base, said post being adapted to engage a switch of a device positioned in said apparatus to prevent actuation of said device;

said first support member comprises a base and a support rod extending from said base, said base of said support member being adapted to engage an end of said base of said apparatus; and a sleeve positioned around said support rod.

7. The apparatus of claim 6, wherein said support rod has a lock head disposed on an end opposite said base of said first support member.

8. The apparatus of claim 6, wherein sleeve has a flared end portion and a flange is positioned on said first support member, said flared end portion of said sleeve being secured to said flange.

9. A mounting apparatus comprising:

a base having a first end and a second end;

a first support member positioned proximate said first end of said base;

a second support member positioned proximate said second end of said base;

a locking bar moveably secured at a first end to said second support member and having at a second end a lock, said lock being adapted to be releasably secured to said first support member; and a post moveably secured to said base between said ends of said base, said post being adapted to engage a switch of a device positioned in said apparatus to prevent actuation of said device;

said second support member comprising a base; and said base having a longitudinally extending axial base extending therethrough and being adapted to engage an end of said base of said apparatus.

10. The apparatus of claim 9, wherein said base of said second support member comprises a conical base.

11. The apparatus of claim 9, wherein said second support member further comprising a sleeve positioned around said locking bar and being secured to said base.

12. A mounting apparatus comprising:

a base having a first end and a second end;

a first support member positioned proximate said first end of said base;

a second support member positioned proximate said second end of said base;

a locking bar moveably secured at a first end to said second support member and having at a second end a lock, said lock being adapted to be releasably secured to said first support member; and a post moveably secured to said base between said ends of said base, said post being adapted to engage a switch of a device positioned in said apparatus to prevent actuation of said device; and a pivot plate pivotably secured to said base, said post extending from said pivot plate.

13. The apparatus of claim 12, wherein said pivot plate comprises a disk.

14. The apparatus of claim 12, wherein said pivot plate comprises a crossbar.

* * * * *